US009683728B2

(12) United States Patent
Ross et al.

(10) Patent No.: US 9,683,728 B2
(45) Date of Patent: Jun. 20, 2017

(54) FLASHLIGHT SYSTEM WITH ACCESSORIZED REPLACEABLE PANELS

(71) Applicant: First-Light USA, LLC, Seymour, IL (US)

(72) Inventors: Jeremy B. Ross, Monticello, IL (US); Brian L. Reed, Bondville, IL (US)

(73) Assignee: First-Light USA, Inc., Seymour, IL (US)

( * ) Notice: Subject to any disclaimer, the term of this patent is extended or adjusted under 35 U.S.C. 154(b) by 165 days.

(21) Appl. No.: 14/595,929

(22) Filed: Jan. 13, 2015

(65) Prior Publication Data

US 2015/0219292 A1 Aug. 6, 2015

Related U.S. Application Data

(60) Provisional application No. 61/926,758, filed on Jan. 13, 2014.

(51) Int. Cl.

| | |
|---|---|
| ***F21L 4/00*** | (2006.01) |
| ***F21V 21/088*** | (2006.01) |
| ***F21L 4/04*** | (2006.01) |
| ***F21V 17/00*** | (2006.01) |
| *F21V 23/04* | (2006.01) |
| *F21V 33/00* | (2006.01) |
| *F21Y 115/10* | (2016.01) |

(52) U.S. Cl.

CPC ..... *F21V 21/0885* (2013.01); *F21L 4/005* (2013.01); *F21L 4/04* (2013.01); *F21V 17/002* (2013.01); *F21V 23/0414* (2013.01); *F21V 33/0036* (2013.01); *F21V 33/0084* (2013.01); *F21Y 2115/10* (2016.08)

(58) Field of Classification Search

CPC .... F21V 21/0885; F21V 21/145; F21V 21/40; F21V 33/008; F21V 33/00; F21W 2111/10; F21L 14/023; F21L 14/14; F21L 14/04; F21L 14/045; B25B 23/18

USPC ..... 362/191

See application file for complete search history.

(56) References Cited

U.S. PATENT DOCUMENTS 4,542,447 A 9/1985 Quakenbush, III
5,167,446 A 12/1992 Haroutunian
(Continued)

FOREIGN PATENT DOCUMENTS

EP 0484891 A2 5/1992

OTHER PUBLICATIONS

First-Light USA, Product Brochure, TOMAHAWK® Tactical Light, undated.

*Primary Examiner* — Anh Mai
*Assistant Examiner* — Matthew Peerce
(74) *Attorney, Agent, or Firm* — Douglas W. Rommelmann; Andrews Kurth Kenyon LLP

(57) ABSTRACT

A flashlight system comprising a housing assembly including a lower member having a longitudinal axis and an upper assembly coupled to the lower member. A light source having an optical axis substantially perpendicular to lower member longitudinal axis is mounted in the upper assembly. Control buttons are coupled to the upper assembly and positioned and spaced in proximity to one another. The lower member includes at least one side plate that is removable. The flashlight system includes a plurality of interchangeable removable side plates providing various features to enhance the overall functionality of the flashlight.

21 Claims, 14 Drawing Sheets

(56) References Cited

U.S. PATENT DOCUMENTS

| | | | | |
|---|---|---|---|---|
| 5,345,368 | A | 9/1994 | Huff | |
| 5,363,285 | A | 11/1994 | Wideman | |
| 5,533,657 | A | 7/1996 | Rosen et al. | |
| 5,556,003 | A | 9/1996 | Johnson et al. | |
| 5,593,074 | A | 1/1997 | Matthews | |
| 5,642,932 | A | 7/1997 | Matthews | |
| 5,752,633 | A | 5/1998 | Antaki | |
| 5,848,834 | A | 12/1998 | Kerr | |
| 6,023,875 | A | 2/2000 | Fell et al. | |
| 6,270,231 | B1 | 8/2001 | Kerr | |
| 7,303,306 | B2 | 12/2007 | Ross et al. | |
| 7,510,294 | B2 | 3/2009 | Steele et al. | |
| 8,075,156 | B2 | 12/2011 | Steele et al. | |
| 2008/0049433 | A1* | 2/2008 | Sharrah | F21L 4/027 362/362 |
| 2008/0074868 | A1* | 3/2008 | Steele | F21L 4/025 362/184 |
| 2012/0033415 | A1* | 2/2012 | Sharrah | F21L 4/027 362/199 |
| 2013/0100653 | A1* | 4/2013 | Renk, Jr. | F21L 4/022 362/184 |

* cited by examiner

FLASHLIGHT SYSTEM WITH ACCESSORIZED REPLACEABLE PANELS

CROSS-REFERENCE TO RELATED APPLICATIONS

This application claims priority to U.S. Provisional Application No. 61/926,758, filed Jan. 13, 2014. Applicant incorporates by reference herein U.S. Provisional Application No. 61/926,758 in its entirety.

BACKGROUND OF THE INVENTION

1. Field of the Invention

The present invention relates generally to flashlights and methods of using same, and in particular to a flashlight system adapted for convenient use in conjunction with other hand-held implements, such as firearms, or in conjunction with activities requiring the use of one's hands.

2. Description of the Related Art

A number of flashlights or flashlight holders are known that are designed for use in conjunction with other hand-held implements, such as, for example, firearms. See U.S. Pat. Nos. 6,270,231; 5,848,834; 5,167,446; 4,542,447; 5,642,932; 5,363,285; 5,556,003; 5,345,368; 6,023,875; 5,752,633; 5,533,657; and 5,593,074; and European Pat. No. EP0484891.

Applicant's U.S. Pat. Nos. 8,075,156 and 7,303,306 disclose flashlight devices for potential use in conjunction with hand-held implements, including firearms, particularly in self-defense and/or combat operations, or when performing other tasks or activities that require two handed operation such as those that commonly occur in industrial environments or outdoor activities.

There is a need for improved flashlight devices for use when performing tasks or activities that require two handed operation such as those that commonly occur in industrial environments or outdoor activities and additionally provide accessories, tools or other devices that may be needed. The present invention is directed to these needs.

SUMMARY OF THE INVENTION

A multi-function flashlight device in one preferred embodiment comprises a housing assembly having a generally rectangular, tubular member for gripping the flashlight device in a user's hand, a combined control and lamp housing rotatably coupled to the rectangular, tubular member, having a light source mounted therein. The light source has an optical axis that is substantially perpendicular to a longitudinal axis of the rectangular, tubular member and can be adjusted horizontally by adjusting the orientation of the combined control and lamp housing to that of the rectangular, tubular member via a rotatable connection. Preferably, the rotatable connection has detents that are provided by the use of a spring and ball assembly located within the combined control and lamp housing that interfaces with corresponding holes or recesses on the rectangular, tubular member. Batteries are housed in the rectangular, tubular member. A control panel having a plurality of buttons are located on the top portion of the combined control and lamp housing. A driver board in the combined control and lamp housing receives signals from the control panel and controls the operation of the light source. The plurality of control buttons are manipulable by a single digit of the user's hand while gripping the flashlight device.

Another feature of a preferred embodiment of the present invention is a finger retainer assembly coupled to the rectangular, tubular member. The finger retainer assembly is preferably arranged and designed to be adjustable relative to the optical axis, preferably adjustable through approximately 260°.

Another feature of the preferred embodiment of the present invention is a hinged battery door that is connected to the lower portion of the rectangular, tubular member. The hinged battery door contains battery contacts that enable the flashlight device to be electrically powered. The hinged battery door is secured in a closed position by a wire retention loop that is connected to a lower front portion of the rectangular, tubular member and surrounds the front portion of the hinged battery door when it is in the closed position, thereby securing it from unintended opening.

Another feature of a preferred embodiment of the present invention is a mounting/retention system having a first component coupled to a side of the rectangular, tubular member and a second component arranged and designed to be attached to the user's clothing or to a mounting surface, with the second component including a receptacle for releasably receiving the first component.

Another feature of a preferred embodiment of the present invention includes removable side plates on the rectangular, tubular member that may feature the first component of the mounting/retention system or a host of other embodiments that enhance the mounting options of the flashlight device and expand the device's overall functionality. Numerous removable side plate embodiments are offered including flexible steel and plastic clips for mounting the flashlight device to clothing, magnets for mounting the flashlight device to ferrous surfaces, cutting utensils, bottle and can opening utensils, fire starting tools, a tape measure, a screwdriver, and a corkscrew amongst others. There is also a "standard" removable side plate that does not offer any expanded functionality, but creates a flat, smooth surface on the side of the rectangular, tubular member for enhanced ergonomics. The preferred embodiment of the present invention retains two removable side plates, one on each side of the rectangular, tubular member. The removable side plates are interchangeable with one another, so the user can choose which side of the flashlight device to position any of the side plates. The removable side plates are installed on the flashlight device on either side of the rectangular, tubular member using a slidable tongue and groove type connection although other connections such as snap fitting or mechanically mounting the side plates could be considered. The edges of the removable side plates form ridges that correspond to grooves formed into to the rectangular tubular member. Ridges on the top and bottom of the side plates correspond to grooves located in the top portion of the rectangular, tubular member and the hinged battery door respectively. Due to this arrangement, the removable side plates are secured via all four edges when the hinged battery door is closed and secured with the wire retention loop. Opening the hinged battery door allows for the removable side plates to be removed by sliding the panel out and away from the rectangular, tubular member.

BRIEF DESCRIPTION OF THE SEVERAL VIEWS OF THE DRAWINGS

A better understanding of the present invention can be obtained when the following detailed description of the disclosed embodiments is considered in conjunction with the following drawings, in which.

DESCRIPTION OF THE PREFERRED EMBODIMENTS

Figure 1:
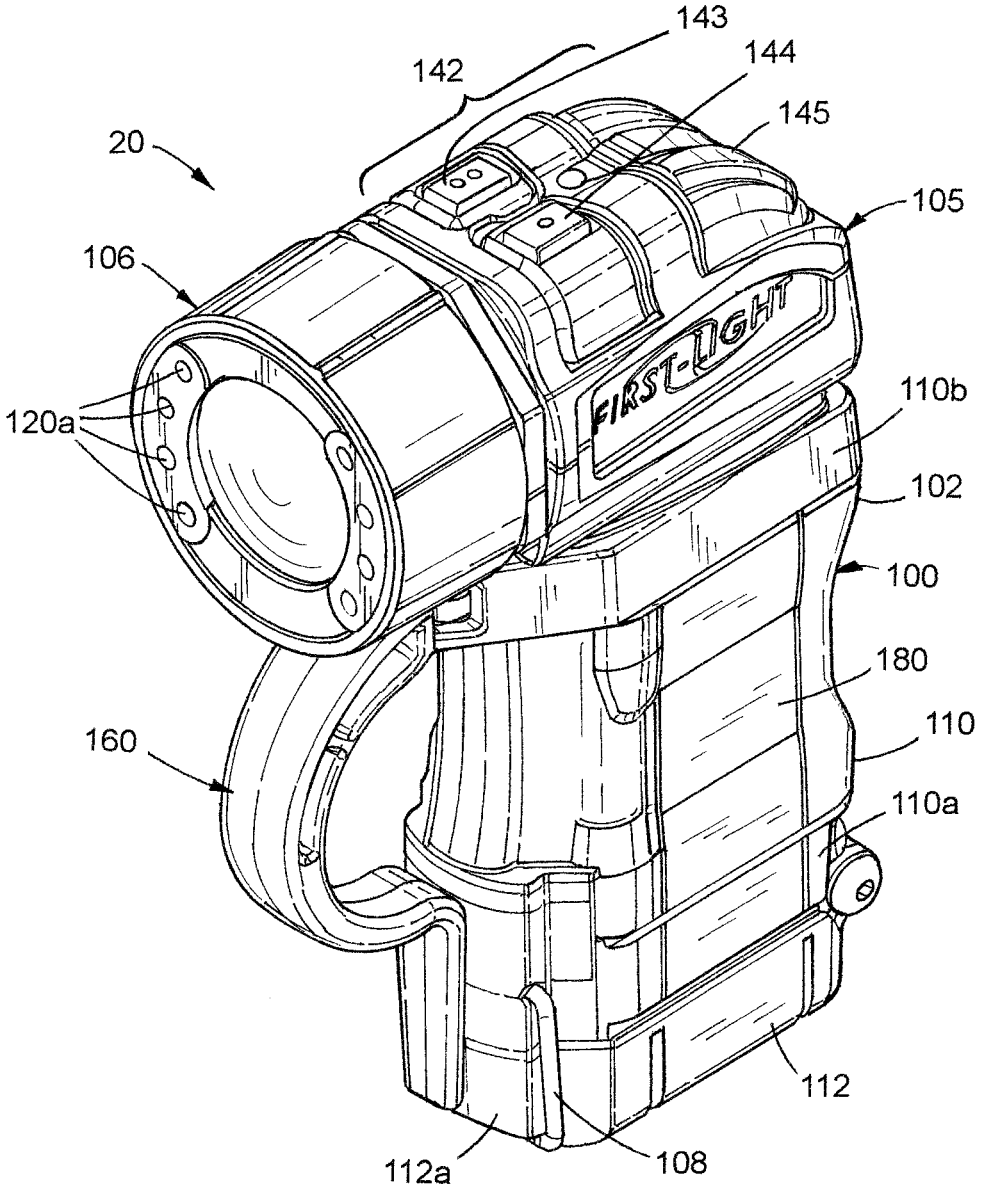
FIG. 1 is a perspective view of a flashlight device according to a preferred embodiment of the present invention.
Figure 5:
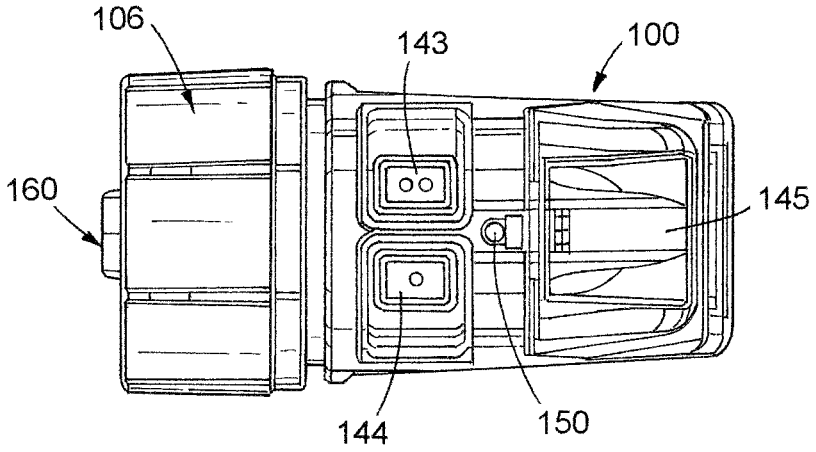
FIGS. 5 and 6 are top and bottom views, respectively, of the flashlight device of FIG. 1.
Figure 6:
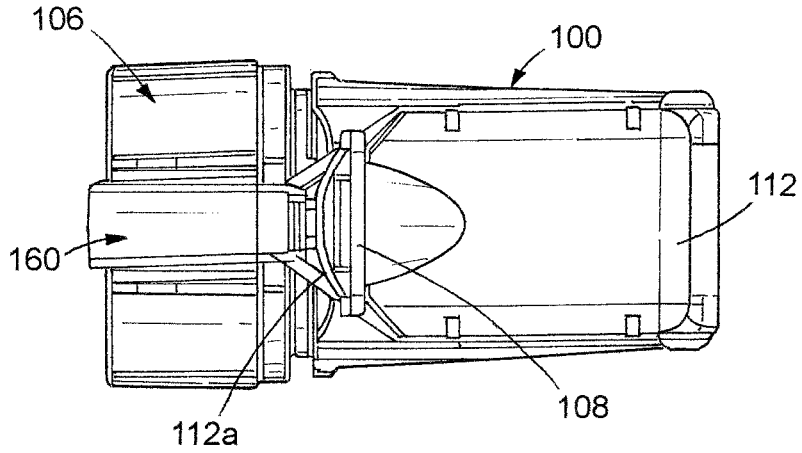
Figure 5A:
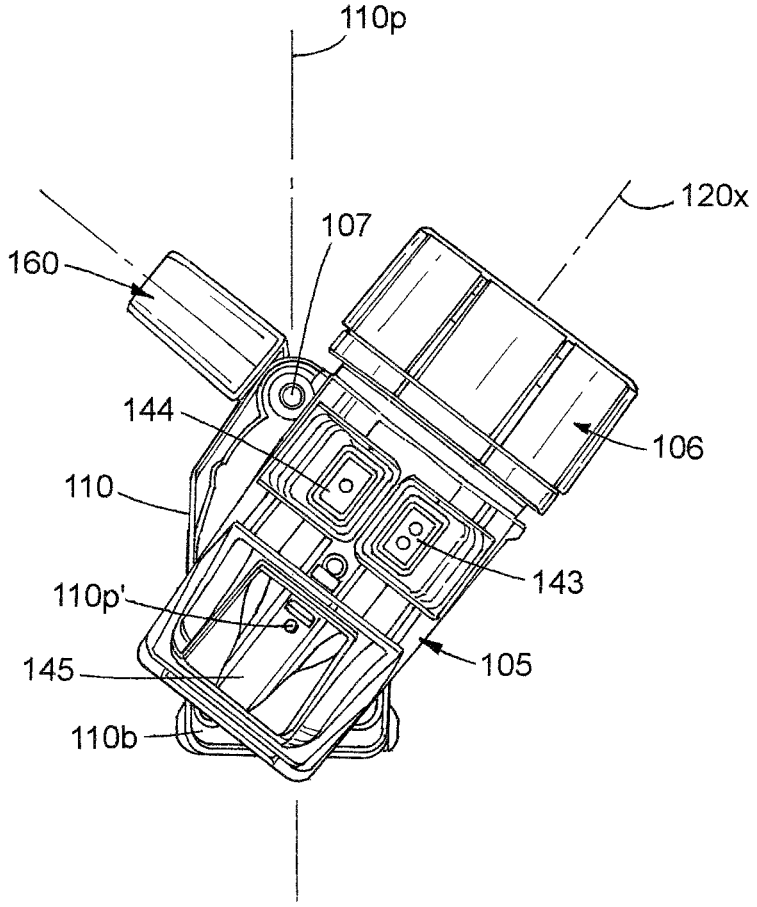
FIG. 5A is a top view of the flashlight device of FIG. 1 showing angular adjustability of the optical axis and a finger retention assembly relative to a generally rectangular, tubular member.

The flashlight system according to a preferred embodiment of the present invention will now be described with specific reference to the drawings. The flashlight system, generally referred to as 20, comprises a flashlight device 100, a finger retainer assembly 160, and one or more removable side plates 180. A preferred embodiment of the flashlight device 100 is shown in perspective view in FIG. 1. The flashlight device 100 includes a housing assembly 102, preferably manufactured from a sturdy and durable material, for example, glass-filled nylon polymer and overmolded with a softer durometer rubber-like material for comfort while held in the hand. Preferably, the housing assembly 102 includes the control and lamp housing 105, a bezel assembly 106, and a tubular member 110. The tubular member 110 is preferably substantially hollow with dual cored cylindrical areas for housing batteries for powering the flashlight device 100. A battery door 112 is coupled, preferably via a hinge or pin connection, to a lower end 110*a* of the tubular member 110 as shown in FIG. 1. In the preferred embodiment, the hinged battery door 112 is movable, swinging down and away from the tubular member 110 to replace and/or insert batteries in the flashlight device 100. An upper end 110*b* of the tubular member 110 is coupled, preferably rotatably, to the combined control and lamp housing 105 as shown in FIG. 5A. Still referring to FIG. 1, the combined control and lamp housing 105 is coupled to the bezel assembly 106, preferably via a press fit connection.

In the preferred embodiment of the present invention, the rectangular tubular member 110 has a centerline or longitudinal axis and the combined control and lamp housing 105 has a centerline or longitudinal axis. Preferably, the combined control and lamp housing 105 is coupled to the rectangular, tubular member 110 such that when the longitudinal axis/centerline of the rectangular tubular member 110 is substantially vertical, the longitudinal axis/centerline of the combined control and lamp housing 105 is substantially horizontal, thus being substantially transverse to one another (forming substantially a 90 degree (90°) angle).

Figure 2:
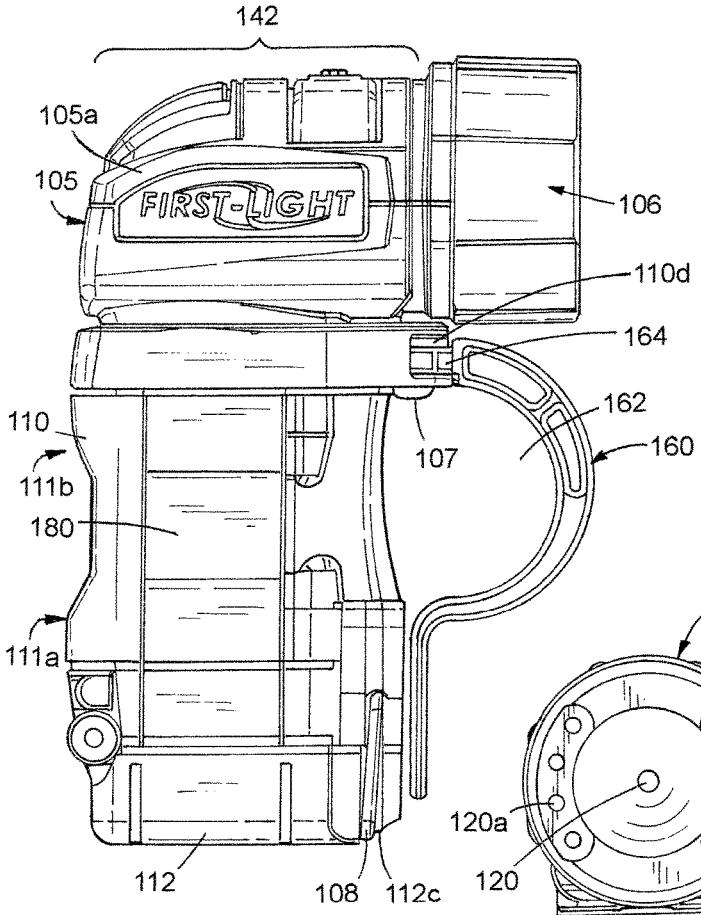
FIG. 2 is a side elevation view of the flashlight device of FIG. 1.
Figure 3:
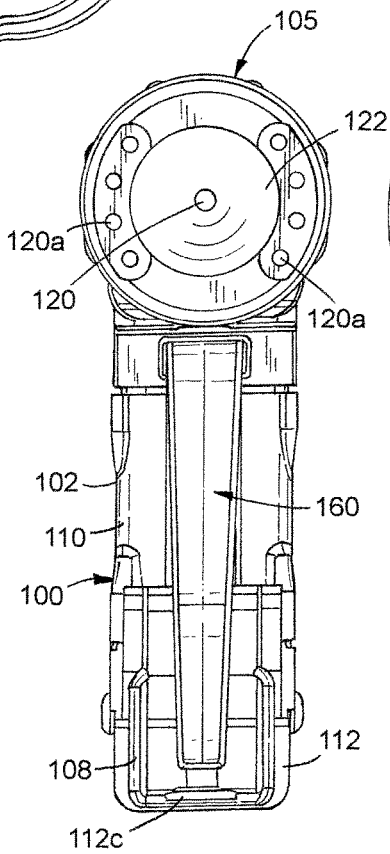
FIGS. 3 and 4 are front and rear elevation views, respectively, of the flashlight device of FIG. 1.
Figure 4:
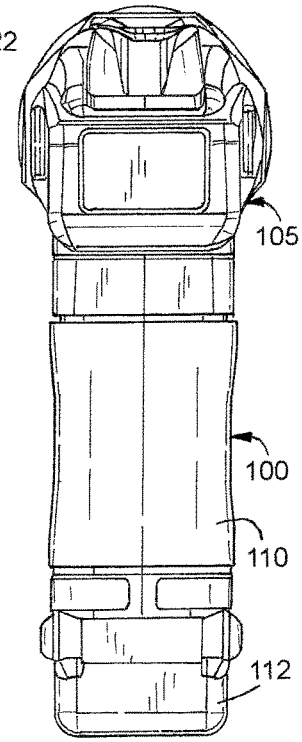

Referring to FIGS. 2 and 3, the combined control and lamp housing 105 includes at least one light source 120 and a reflector 121 (FIGS. 17-19) positioned behind a lens 122 within the bezel assembly 106. The light source 120 is energizable by batteries, preferably alkaline or lithium batteries, in the housing assembly 102. Preferably, the light source 120 is capable of delivering a high intensity white light. Higher or lower intensities may also be desirable for particular utilities for the flashlight device 100. The light source 120 may, for example, include a halogen, xenon or other pressurized gas bulb, or a light emitting diode (LED).

Additionally, it is to be understood that the flashlight device 100 of FIGS. 2 and 3 preferably includes a plurality of light sources, including light sources of different output wavelengths or color and/or intensities. For example, FIGS. 1 and 3 show a preferred embodiment of the flashlight device, referenced as 100, having a plurality of light sources 120 and 120*a*. The flashlight device 100 includes a centrally positioned primary light source 120 and a plurality of peripherally spaced secondary light sources 120*a*. The flashlight device 100 shown in FIG. 3 includes eight secondary light sources 120*a*, although it is to be understood that the number of secondary light sources 120*a* in this embodiment can alternatively be one or a plurality of light sources.

In the preferred embodiment of the flashlight device 100, the primary light source 120 is a high intensity LED with a white light output. The secondary light source 120*a* of the flashlight device 100 preferably includes a plurality of colors or output wavelengths. Preferably, each color of secondary lights 120*a* is spaced around the primary light source 120. It is to be understood that the light sources 120 and 120*a* could include other color/wavelength options including, but not limited to, infrared, ultraviolet and microwaves.

Preferably, the control panel 142 is situated in an upper section 105*a* of the combined control and lamp housing 105.

The control panel 142 is preferably a multi-function control panel capable of providing signals to a driver board that processes the received signals and implements the required function. The control panel 142 of the preferred embodiment interfaces with a printed circuit board ("PCB") having conductive elements activated by pressure sensitive buttons 143, 144, and 145 as shown in FIG. 5. In the preferred embodiment shown in FIGS. 1 and 5, the control panel 142 includes a momentary "on" button 145, a constant "on" white light control button 144 and a secondary color constant "on" control button 143 to control multiple functions of the flashlight device 100. Preferably, the buttons 143, 144 and 145 each include a raised surface to allow identification of the buttons by tactile sensation or touch without the need to identify visually. Additionally, the location and height of the buttons on the control panel 142 provides for one hand, single digit operation, preferably thumb operation.

Preferably, the control panel 142 is positioned above the rectangular, tubular member 110 as shown in FIG. 1 to provide convenient access to the control buttons 143, 144 and 145 during use of the flashlight device 100. The positioning of the control buttons 143, 144 and 145 on the flashlight device 100 provides convenient access in various gun firing positions, including a two-handed combat position, or other manual hand activities. In the preferred embodiment, the buttons 143, 144 and 145 are shaped, positioned and spaced sufficiently to be tactilely recognized and easily separately depressed in addition to being adjacent one another to permit simultaneous or concurrent manipulation or depression of two buttons with a single digit of one hand of the user, preferably a thumb. Preferably, the control buttons of the control panel 142 are manipulated by a single thumb and are positioned such that the user's thumb can manipulate any one of the buttons 143, 144 and 145 separately, or simultaneously or concurrently manipulate combinations of the buttons to perform various functions or operational modes. Preferably, the keypad buttons can be manipulated by the thumb without adjusting the user's grasp of the flashlight device 100, as described below, and also without having to adjust the user's grip of the firearm when in use with a firearm.

Figure 16:
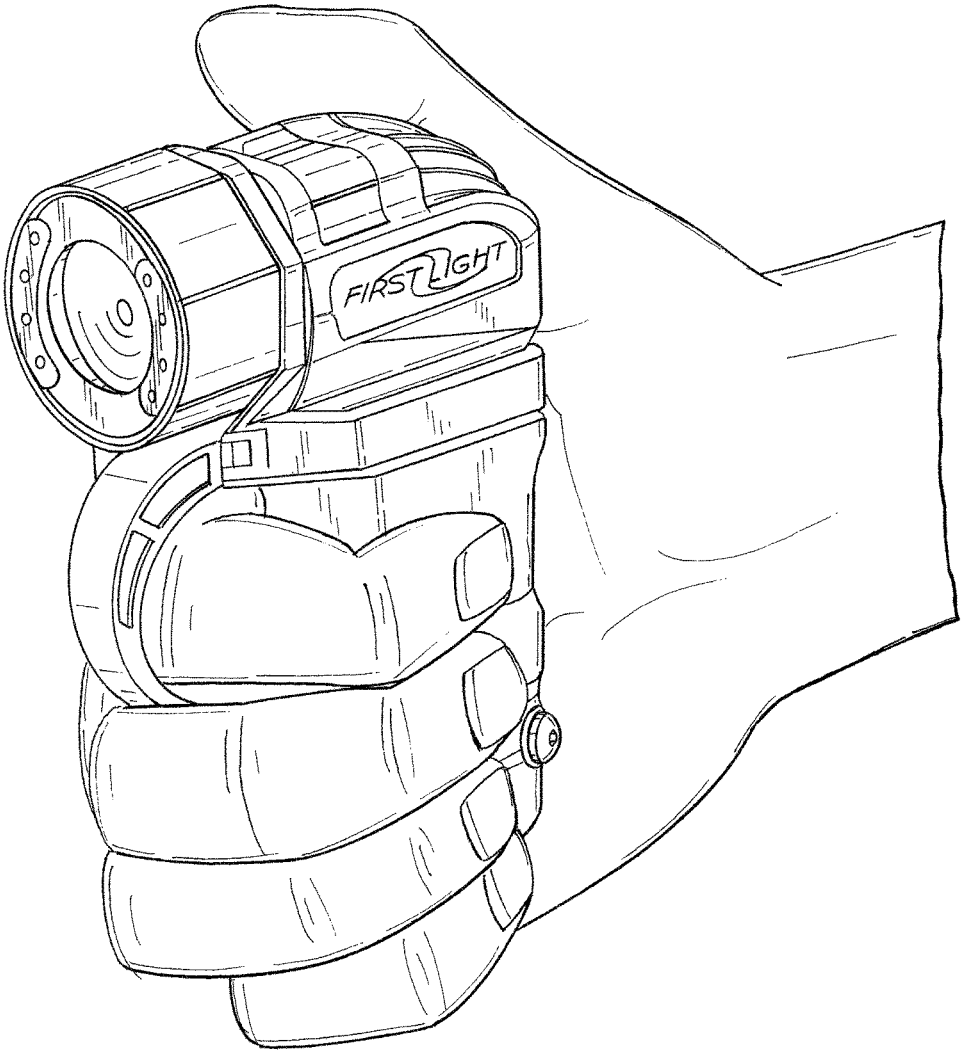
FIG. 16 is a perspective view illustrating the flashlight device held and being operated in the user's hand.

As shown in FIG. 16, the flashlight device 100 is preferably grasped by wrapping one or more fingers of one hand of the user substantially around the rectangular, tubular member 110 and placing the thumb of the hand on or above the control panel 142. Preferably, the back of the generally rectangular, tubular member 110 includes a surface defining a hip 111*a* and a shoulder 111*b*, as shown in FIG. 2, to provide a quick indexing point and to conform to the wrapped fingers of a gun hand when used with a gun.

Preferably, the flashlight device 100 includes a "lockout" to ensure that the momentary "on" button 145 or the constant "on" buttons 143 and 144 are not inadvertently depressed in their "on" state while the flashlight device 100 is stored, thus draining the batteries and leaving the flashlight device 100 "dead" when needed. In one embodiment of the present invention, the lockout is activated by simultaneously depressing the buttons 143 and 144 when no light sources are on and the lockout is deactivated in the same manner. In the lockout condition, the light source 120 cannot be powered by any one of the buttons 143, 144, and 145 being pressed to their "on" state. This ensures that the flashlight device 100 is not inadvertently on while stored and is ready for use when needed by the user. In the preferred embodiment, the control panel 142 includes at least one indicator lamp 150 (FIG. 5) to provide visible indication of the "lockout" status as to whether the flashlight device 100 is "locked" or "unlocked," preferably by illuminating a symbol or icon in the upper surface of the control panel 142.

Figure 17:
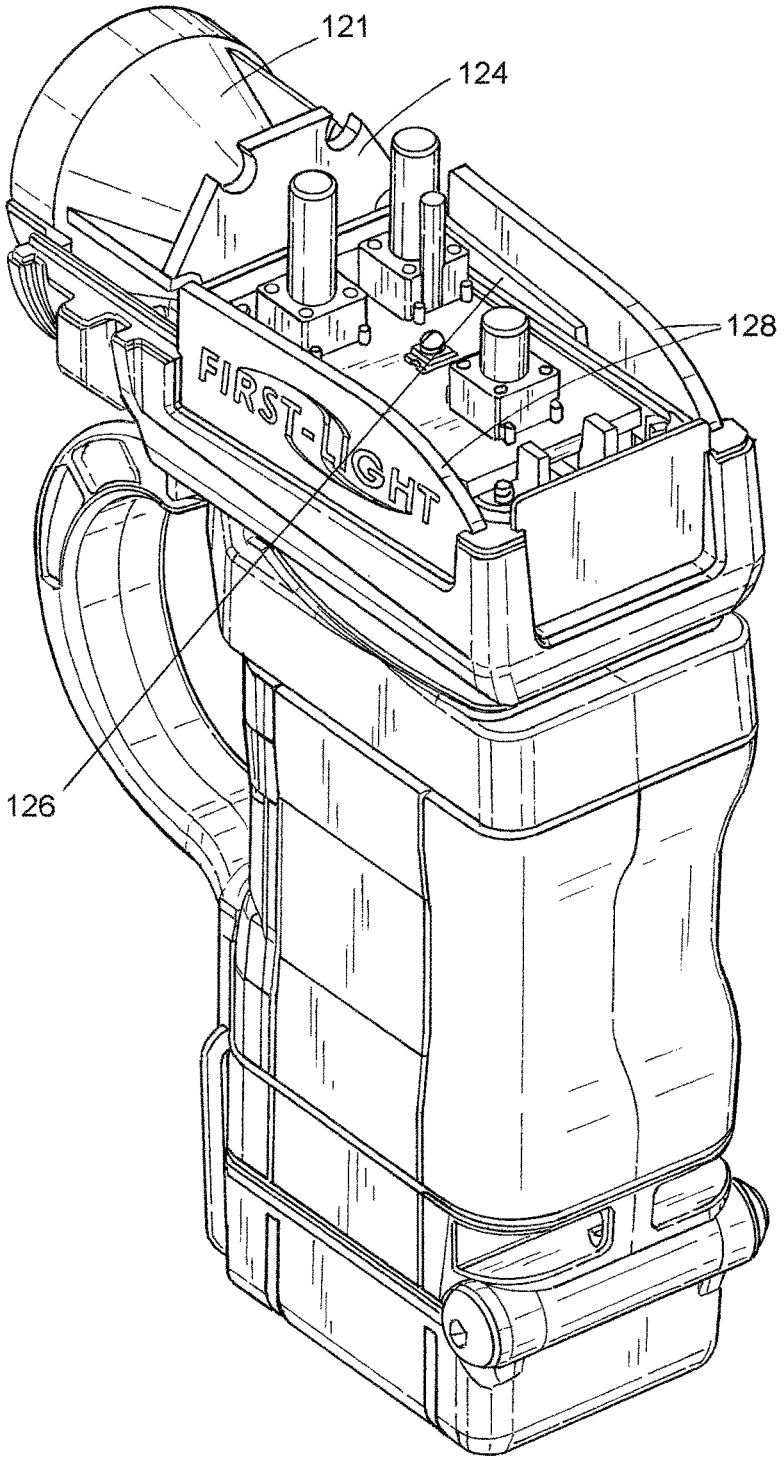
FIG. 17 is a perspective view of the flashlight device of FIG. 1 with an upper portion of the flashlight device removed.
Figure 19:
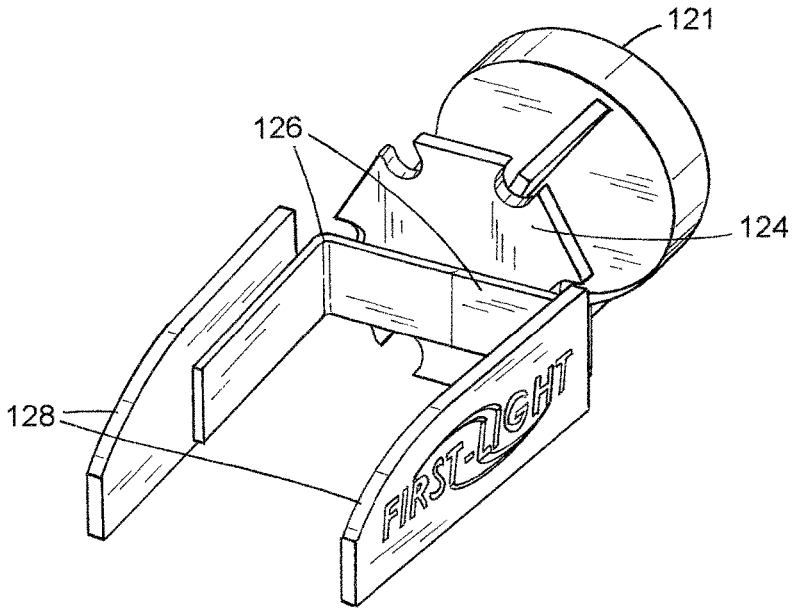
FIG. 19 is a perspective view of a reflector, mounting board and heat conductive members.
Figure 18:
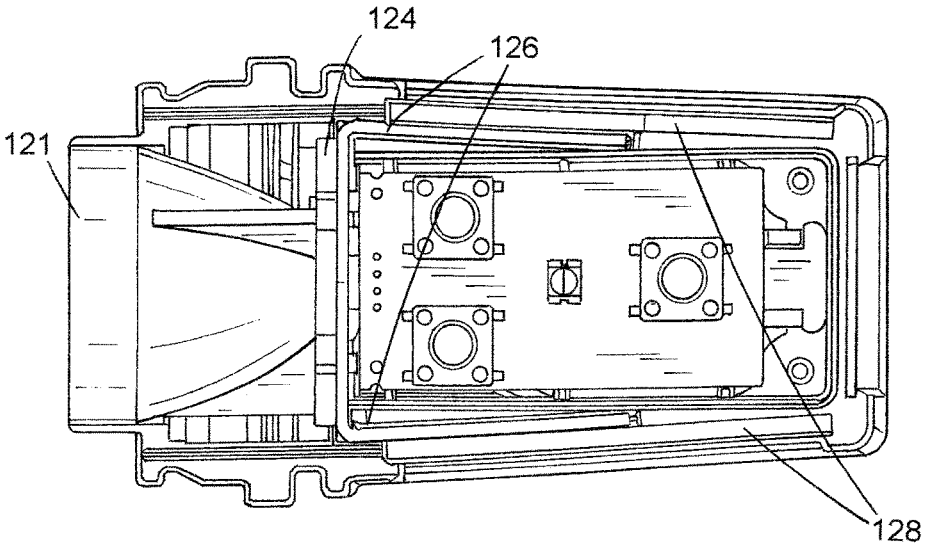
FIG. 18 is a top view of FIG. 17.

A preferred embodiment of the flashlight device 100 is further shown in FIGS. 17-19. In FIGS. 17 and 18 the upper portion of the flashlight device including the control panel 142, buttons 143, 144, and 145 and upper portion of the bezel assembly 106 have been removed. FIG. 19 shows the reflector 121 and an LED mounting board 124 for mounting the one or plurality of light sources. Heat conductive elements 126 are in contact with the mounting board 124 and with exposed side panels 128, preferably made of metal. The heat conductive elements 126 draw heat, generated by the light sources, away from the light sources to the exposed metal side panels where the heat is released to the environment. As compared to an all plastic housing, the increased heat conductivity of this embodiment effectively increases LED performance, efficiency and lifespan.

A preferred embodiment of the finger retainer assembly 160 of the flashlight system 20 is shown coupled to the generally rectangular, tubular member 110 of the flashlight device 100 in FIGS. 1-3 and 7-16. With reference to FIG. 2, the finger retainer assembly 160 preferably defines a substantially "D"-shaped opening 162 with the rectangular, tubular member 110.

Figure 7:
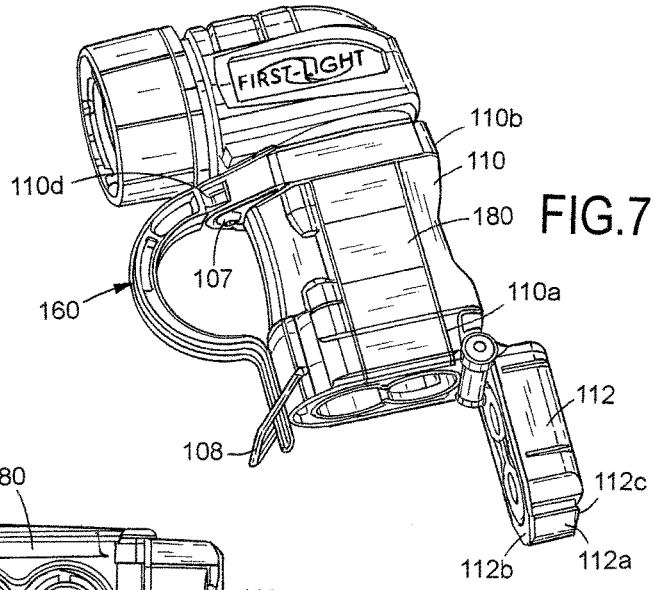
FIG. 7 is a perspective view of the flashlight device of FIG. 1 with the hinged battery door in the open position.
Figure 8:
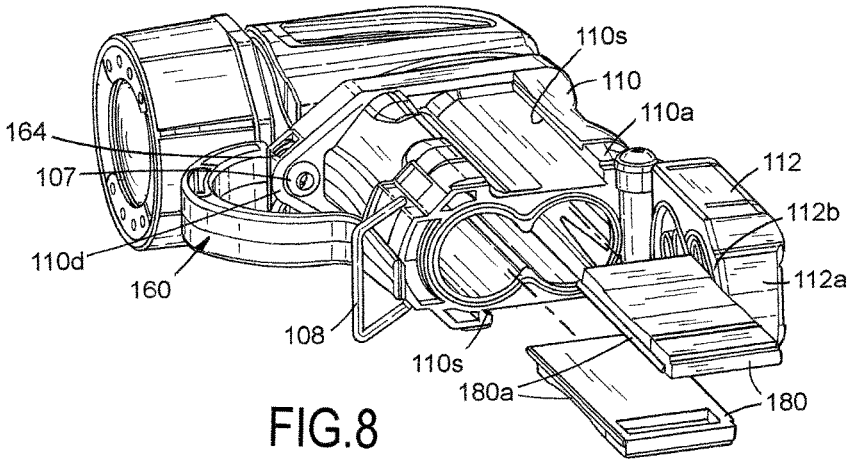
FIG. 8 is a perspective view of the flashlight device of FIG. 1 with the hinged battery door in the open position and the removable side plate removed.

As shown in FIGS. 2, 7 and 8, in the preferred embodiment a first end portion 164 of the finger retainer assembly 160 is arranged and designed to connect to a connecting portion 110*d* of the rectangular, tubular member 110 via a threaded screw 107 (FIG. 2). Preferably the finger retainer assembly 160 can be adjusted and fixed in the user's desired position by tightening the threaded screw. As shown in FIG. 5A, the preferred embodiment allows the angular position of the finger retainer assembly 160 relative to an optical axis 120*x* of the light source 120 to be adjusted in a horizontal plane (when the rectangular, tubular member 110 is in a vertical orientation) by untightening the threaded screw 107, making the desired adjustment, and re-tightening the threaded screw. It is also to be understood that the finger retainer assembly 160 can be adjusted with the tension on the threaded screw 107 being tight enough to keep the finger retainer assembly 160 from freely moving, but loose enough to allow the user to move the finger retainer assembly without further loosening the screw 107. The angular positioning of the finger retainer assembly 160 travels through an arc about the screw 107.

It is to be further understood that the finger retainer assembly 160 is removable by removing the screw 107 and pulling the finger retainer assembly 160 straight out towards the front of the tubular member 110. Additionally, the flashlight system 20 may include a plurality of finger retainer assemblies 160 with each forming a different size of substantially "D"-shaped opening 162 with the rectangular, tubular member 110 to allow the user to select one that best fits the user's finger. It is to be understood that only one finger retainer assembly 160 would be mounted to the flashlight device 100 at any time.

FIG. 5A further illustrates the rotatable movement and angular positioning of the optical axis 120*x* relative to a vertical plane 110*p* passing through the center of the generally rectangular, tubular member 110. The angular positioning of the optical axis 120*x* relative to the vertical plane 110*p* travels through an arc about a rotatable connection pivot point 110*p*' between the rectangular tubular member 110 and the combined control and lamp housing 105, preferably lying along an intersection of the vertical plane 110*p* and a vertical plane including the optical axis 120*x*. Preferably, the control and lamp housing 105 and the optical axis 120*x* are allowed to rotate approximately 180° (approximately 90° to the left and 90° to the right of the forward position of FIG. 1). More preferably, the control and lamp housing 105 and the optical axis 120*x* are allowed to rotate in the range of 180° to 320° (90° to 160° to the left and 90° to 160° to the right of the forward position of FIG. 1).

In a preferred embodiment, a top surface 112*b* of the hinged battery door 112 includes a compressible seal adapted to engage the lower surface of the rectangular, tubular member 110 and the side plates 180 upon closure to provide a waterproof interior compartment. Referring to FIGS. 2 and 3, preferably the lower end of the front portion 112*a* of the battery door 112 includes a teat 112*c* which serves to normally maintain the retention loop 108 securely around the battery door 112. The compressible seal provides a slight amount of compression to allow the retention loop 108 to pass over the teat 112*c*, yet retain the retention loop 108 during normal conditions.

Referring to FIG. 7, the batteries can be replaced by opening the hinged battery door 112 away from the lower portion 110*a* of the rectangular, tubular member 110 by slightly forcing the front portion 112*a* of the battery door 112 towards the rectangular tubular member 110 to permit the wire retention loop 108 to pass over the teat 112*c* and swing away and clear of the hinged battery door 112. This allows access to the batteries. To return to an operating condition, the batteries are installed and the hinged battery door 112 is closed against the lower portion 110*a* of the rectangular tubular member 110. The wire retention loop is then swung down and passed over the teat 112*c* into a position where it surrounds the front portion 112*a* of the hinged battery door 112 as shown in FIG. 1.

Figure 7A:
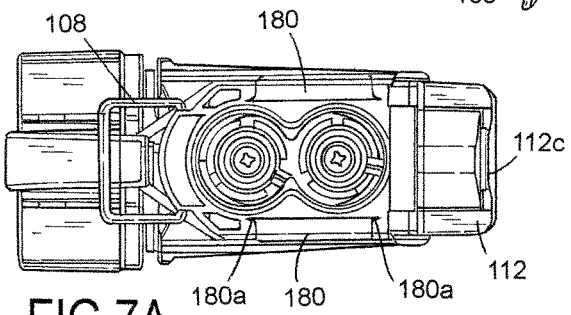
FIG. 7A is a bottom view of the flashlight device of FIG. 1 with the hinged battery door in the open position.

In reference to FIGS. 7, 7A and 8, the rectangular, tubular member 110 of flashlight device 100 is constructed to preferably accept two removable side plates 180, one on each side of the rectangular, tubular member. The removable side plates 180 are installed onto the flashlight device by opening the hinged battery door 112 by swinging it away from the lower portion 110*a* of the rectangular, tubular member 110. This is accomplished by first releasing the wire retention loop 108 from the front portion 112*a* of the hinged battery door 112. Once the hinged battery door has cleared the bottom of the removable side plates 180, the plates can be slidably removed from the rectangular, tubular member 110. Preferably, the removable side plates are held in position by an interference fit with the tubular member 110. In a preferred embodiment the sides of the removable side plate 180 include a prominent ridge 180*a* which is received in a corresponding slot 110*s* present on the sides of rectangular tubular member 110. Preferably, the underside of the top portion 110*b* of the rectangular, tubular member 110 also includes slots to receive a corresponding ridge on the upper end of the side plate. The ridges 180*a* may be beveled or slanted surfaces with the slots 110*s* having corresponding mating beveled or slanted surfaces to secure the removable side plate 180 to the tubular member 110.

Figure 9:
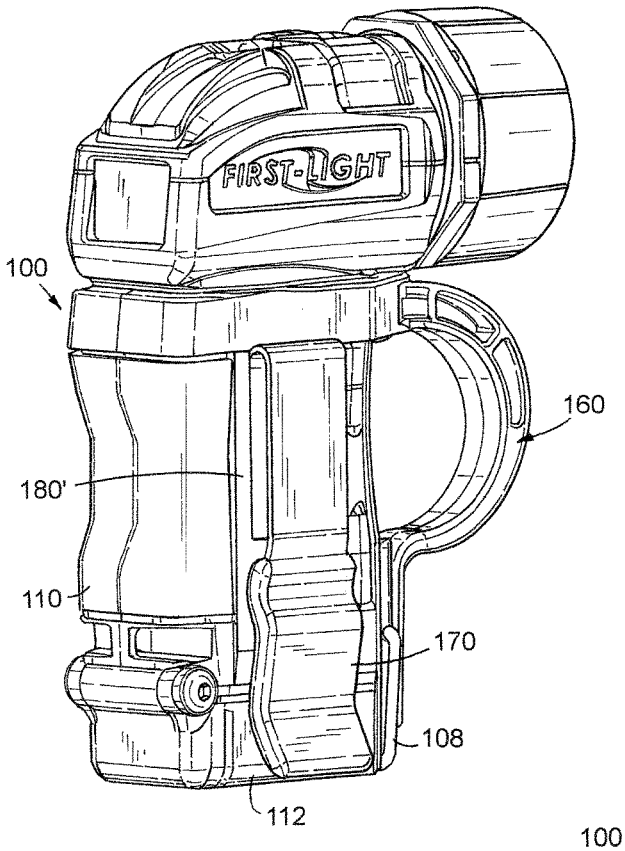
FIG. 9 is a perspective view of a second preferred embodiment of the flashlight device with a belt clip removable side plate installed.
Figure 11:
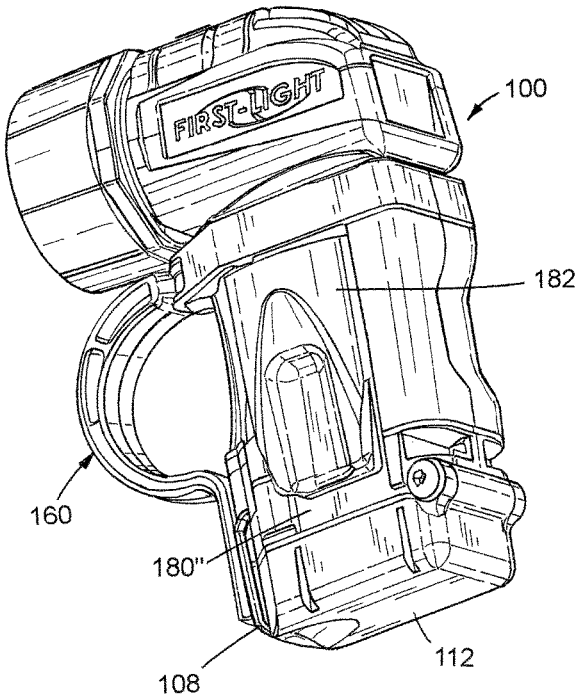
FIG. 11 is perspective view of a third preferred embodiment of the flashlight device with the removable side plate housing the first component of a mounting/retention system installed.
Figure 20:
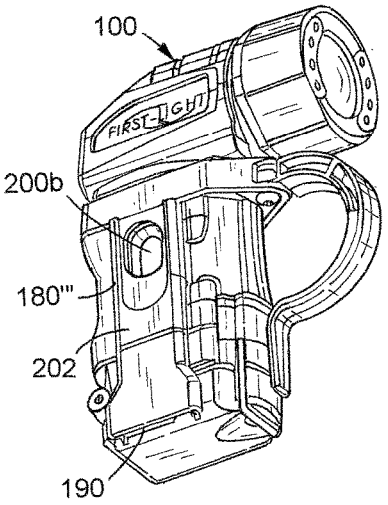
FIG. 20 is a perspective view of a fourth preferred embodiment of the flashlight device with the removable side plate housing a strap cutter shown in a retracted position.
Figure 21:
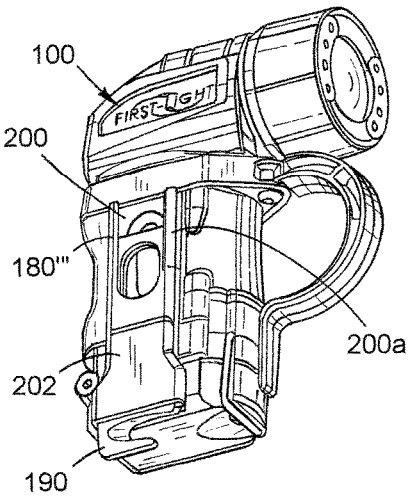
FIG. 21 is a view similar to FIG. 20 showing the strap cutter in an extended position.
Figure 22:
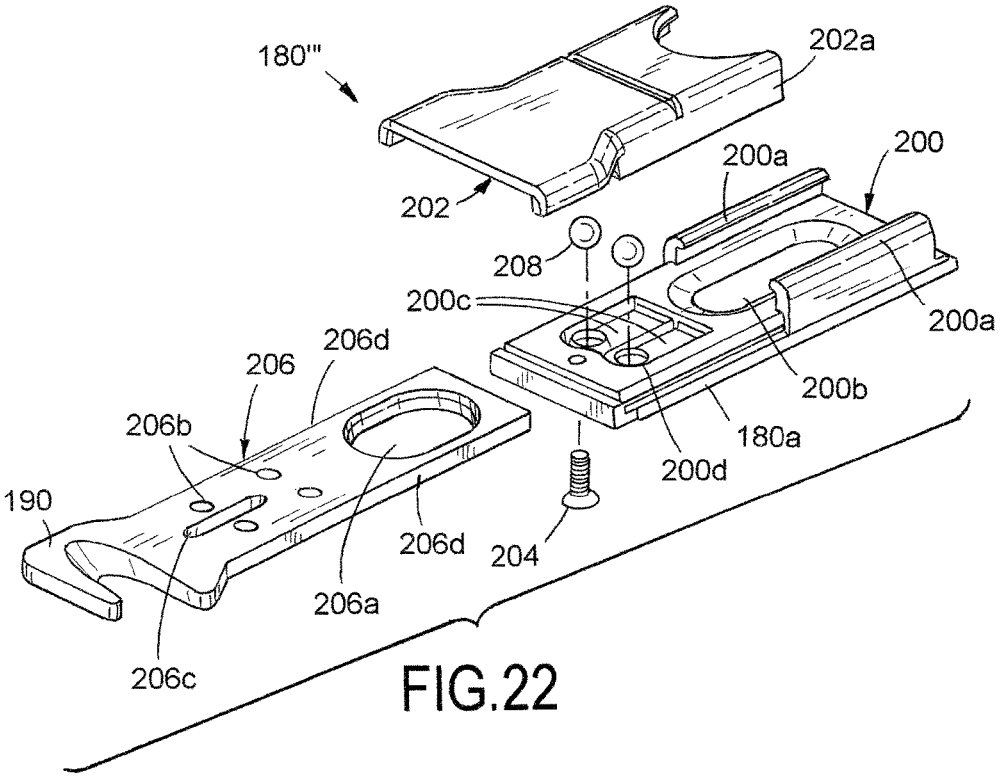
FIG. 22 is an exploded view of the removable side plate housing the strap cutter.

Five distinct embodiments of removable side plates are shown in the figures: the "standard" removable side plate 180 in FIG. 1, a belt clip 170 coupled to a removable side plate 180' in FIG. 9, a first mating component 182 as part of a removable side panel 180" in FIG. 11, and a strap cutter 190 or a bottle opener 192 coupled to a removable side panel 180''' in FIGS. 20-22.

Figure 10:
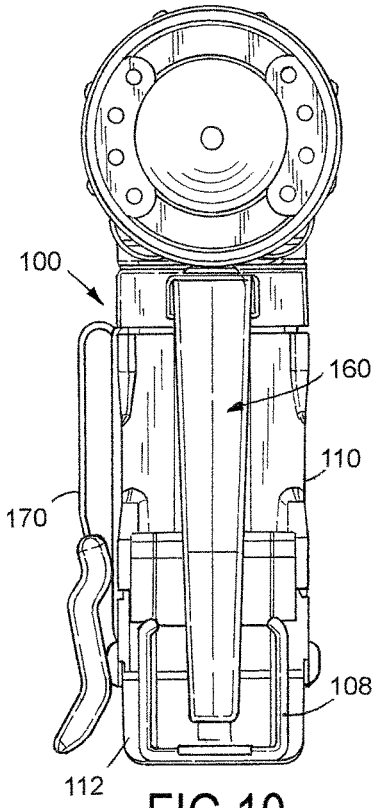
FIG. 10 is a front elevation view of the flashlight device of FIG. 9.

FIGS. 9 and 10 show the flashlight device 100 having a finger retainer assembly 160 and a belt clip 170. The belt clip 170 is arranged and designed to clip onto the user's belt or other article of clothing or portion of a uniform, including for example a soldier's uniform, forming a friction fit. Such clips are well known in the art. Preferably, the belt clip 170 is fixedly mounted to the removable side plate 180' by molding, fasteners, or by a receptacle in the side plate 180' receiving a portion of the belt clip 170.

Figure 12:
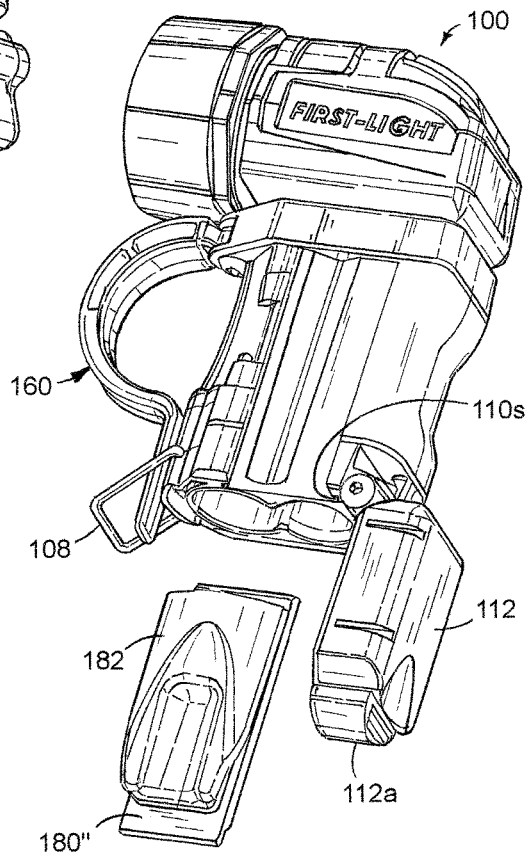
FIG. 12 is a perspective view of the flashlight device of FIG. 11 showing the removable side plate housing the first component of the mounting/retention system removed.

FIG. 12 shows the side panel 180" having the first mating component 182 removed from the flashlight device 100. With the battery door 112 in its open position the side panel 180" can be slidably inserted into the slots 110*s* of the tubular member 110 into the position shown in FIG. 11 and the battery door 112 can then be closed. The first mating component 182 is designed and arranged to be a mating component of the mounting/retention system 188 shown in FIGS. 13, 14 and 15. The mounting/retention system 188 preferably includes first and second mating components 182 and 184, respectively, to permit "hands-free" applications. Referring to FIGS. 11 and 12, the first mating component 182 is preferably an elongated dovetail extension, extending from the removable side plate 180", adapted to be slidably received within a corresponding receptacle 186 of the second mating component 184 (FIG. 15).

Figure 13:
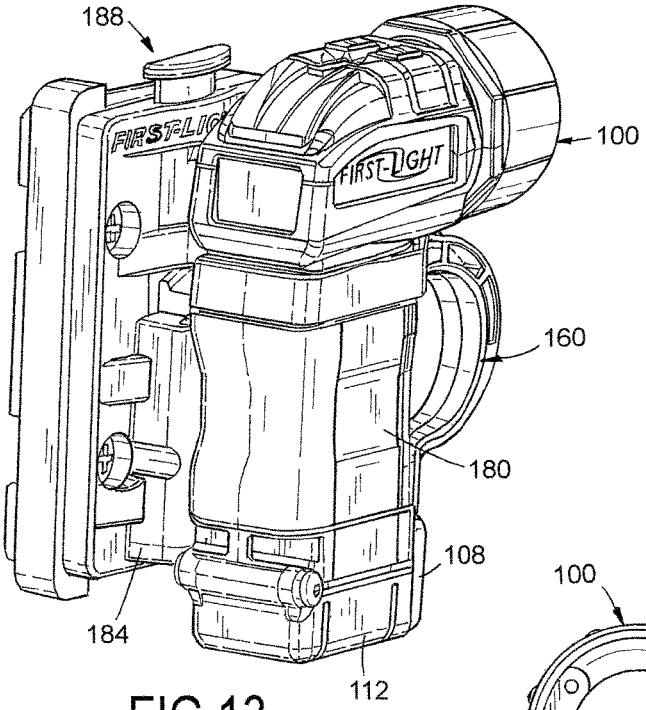
FIG. 13 is a perspective view of fourth preferred embodiment of the flashlight device showing the flashlight device coupled to a second component of the mounting/retention system.
Figure 14:
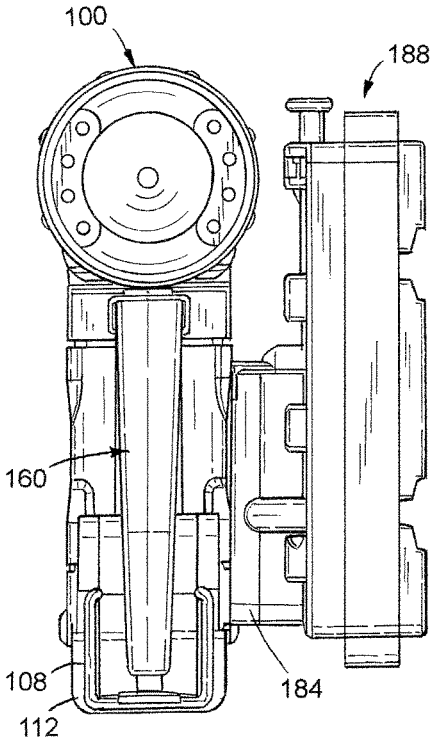
FIG. 14 is a front elevation view of the flashlight device of FIG. 13.
Figure 15:
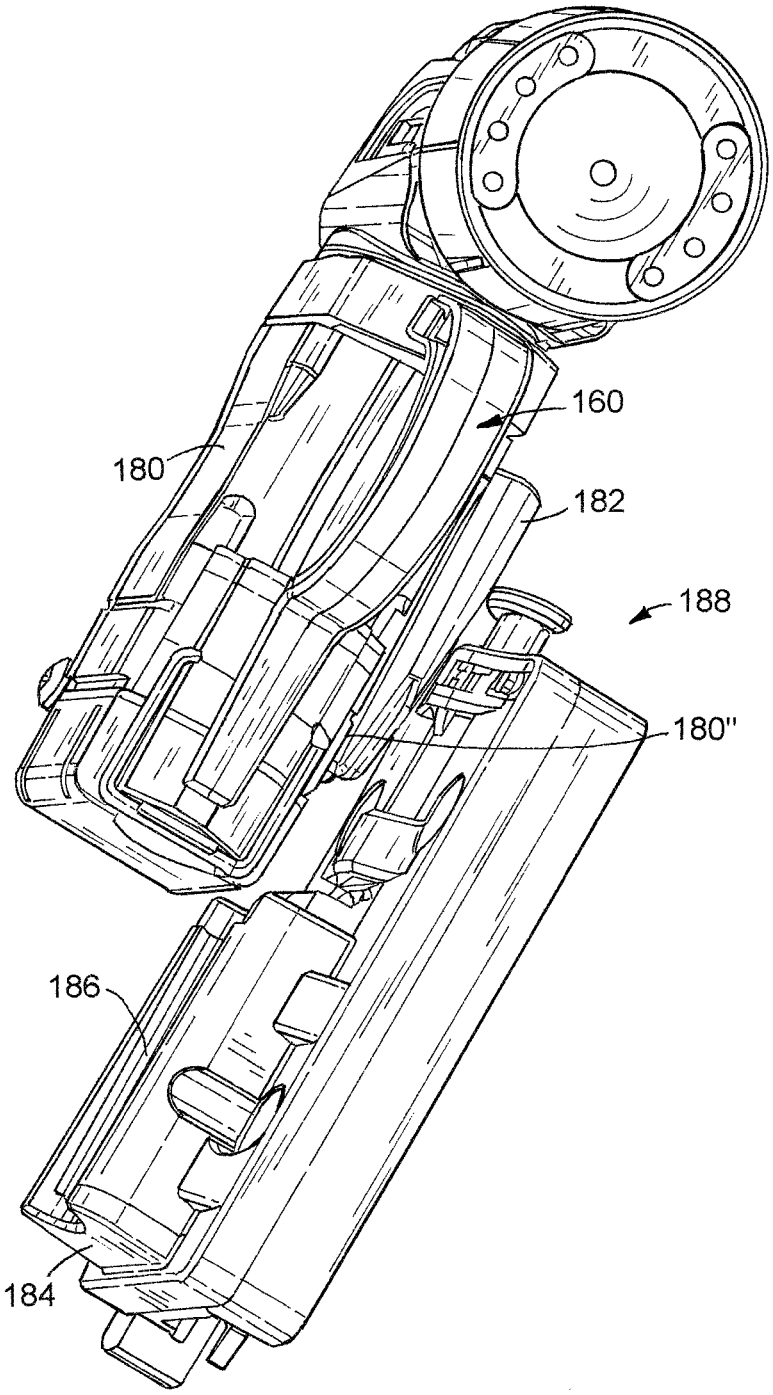
FIG. 15 is a perspective view of the flashlight device of FIG. 13 illustrating the removal of the first component from the second component of the mounting/retention system.

It is to be understood that when the flashlight device 100 is mounted to the mounting/retention system 188 (FIGS. 13 and 14) via the removable side plate 180", the optical axis of the flashlight device is preferably adjustable through at least 90°, and more preferably through 160°, of orientation relative to the orientation shown in FIGS. 13 and 14.

Figure 23:
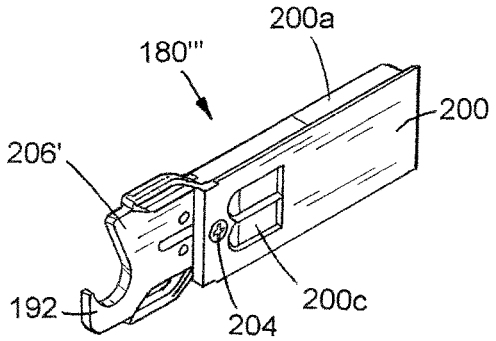
FIG. 23 is a perspective view of a removable side plate with a bottle opener in an extended position.

FIGS. 20 and 21 show the flashlight device 100 with the removable side plate 180''' housing the strap cutter 190 in a retracted position and an extended position, respectively. FIG. 22 is an exploded view of the removable side plate 180''' housing the strap cutter 190. FIG. 23 shows a bottle opener 192, instead of the strap cutter 190, housed in the removable side plate 180''' in the extended position. It is to be understood that the only difference between the removable side plate 180''' of FIG. 23 compared to the one of FIGS. 20, 21 and 22 is the bottle opener 192 end portion.

Referring to FIG. 22, the removable side plate 180''' comprises a slider body 200 having ridges 180*a* along the sides of the slider body 200 for mounting to the flashlight device 100. The slider body 200 includes a pair of rails 200*a* in opposed relationship, preferably parallel to one another. Preferably, the slider body 200 includes an oval recess 200*b* and a pair of recessed flex tabs 200*c*. The flex tabs 200*c* have a ball receiver 200*d* at the end portion of the tab. A top cover 202 is arranged and designed to mount onto the slider body 200. The top cover 202 includes a pair of rails 202*a* in opposed relationship. Preferably, the top cover 202 snaps or slides on the slider body 200 and is secured with a fastener 204, preferably a screw. It is to be understood that when the top cover 202 is secured to the slider body 200, the pairs of rails 200*a* and 202*a* are axially aligned to form a continuous rail.

A strap cutter slide 206 (FIG. 22) or a bottle opener slide 206' (FIG. 23) is designed to axially slide within the slider body 200 and top cover 202. Referring to FIG. 22, the slide 206 has a hook-shaped end portion having a beveled, knife-like interior edge forming the strap cutter 190. The slide 206' also has a hook-shaped end portion having a flat interior edge forming the bottle opener 192. The slides 206 and 206' are identical in all other respects and will be further discussed simply as slide 206.

In the preferred embodiment, the slide 206 includes an opening 206*a*, two pair of holes 206*b*, and an elongated slot 206*c* extending therethrough. The slide 206 includes a pair of side edges 206*c* arranged and designed to be slidably received between the pairs of rails 200*a* and 202*a*. The rails

200*a* and 202*a* provide guidance of the slide 206 as it moves axially. A ball 208 is partially received in each ball receiver 200*d* of the flex tabs 200*c* and is arranged and designed to be partially received in one of the holes 206*b*. The fastener 204 extends through the elongated slot 206*c*

In the assembled retracted position as shown in FIG. 20, the hook-shaped end portion of the slide 206 is within the end portion of the top cover 202. Although not shown, the balls 208 are partially received in the pair of holes 206*b* nearest to the hook-shaped end portion of the slide 206. It is to be understood that the arrangement of the balls 208 and flex tabs 200*c* provide a detent or spring force to maintain and bias the slide 206 in the retracted position. To position the slide in the extended position, the user inserts a finger in the slide opening 206*a* and pushes the slide axially. The user overcomes the detent or spring force and forcibly slides the slide 206 until further axial movement is restricted, for example, by the end of the elongated slot 206*c* contacting the fastener 204. Additionally or alternatively, in the extended position the balls 208 are partially received in the other pair of holes 206*b* to provide a spring force maintaining the slide in the extended position. The slide can be moved back to the retracted position by either pushing on the hook-shaped end portion of the slide 206 or by again using the slide opening 206*a*.

It is to be understood that the finger retainer assembly 160, the belt clip 170, the mounting/retention system 188, the strap cutter 190 and the bottle opener 192 are applicable to all embodiments. It is further to be understood that the flashlight device of the present invention may be used with or without each of the following: finger retainer assembly 160, belt clip 170, removable side plates 180, 180', 180", 180'" and mounting/retention system 188.

While the invention has been described in detail above with reference to specific embodiments, it will be understood that modifications and alterations in the embodiments disclosed may be made by those practiced in the art without departing from the spirit and scope of the invention. All such modifications and alterations are intended to be covered. In addition, all publications cited herein are indicative of the level of skill in the art and are hereby incorporated by reference in their entirety as if each had been individually incorporated by reference and fully set forth.

We claim:

1. A flashlight system comprising:

a housing assembly including a lower member having a longitudinal axis and an upper assembly coupled to the lower member;

a light source mounted in the upper assembly;

at least one control button coupled to the upper assembly for controlling the light source;

at least two removable side plates arranged and designed to be attached to the lower member, each removable side plate providing a different feature to enhance the overall functionality of the flashlight system;

the lower member arranged and designed to have two removable side plates in direct attachment to the lower member at the same time, and a door pivotally connected to a lower end of the lower member, the door having an open position and a closed position, wherein the door in the closed position prevents removal of at least one removable side plate attached to the lower member.

2. The flashlight system of claim 1, wherein one of the removable side plates includes a flexible clip arranged and designed for mounting the housing assembly to an article of clothing.

3. The flashlight system of claim 1, wherein one of the removable side plates includes a hook-shaped end portion having a beveled, knife-like interior edge.

4. The flashlight system of claim 1, wherein one of the removable side plates includes a hook-shaped portion arranged and designed to remove a cap from a bottle.

5. The flashlight system of claim 1, wherein the door in the open position allows removal of the at least one removable side plate attached to the lower member.

6. The flashlight system of claim 1, wherein the upper assembly is rotatably coupled to the lower member.

7. The flashlight system of claim 6, wherein the light source has an optical axis substantially perpendicular to the longitudinal axis of the lower member.

8. The flashlight system of claim 1, further comprising a finger retainer assembly coupled to the lower member, the finger retainer assembly defining a substantially "D" shaped opening with the lower member.

9. A flashlight system comprising:

a housing assembly including a lower member having a longitudinal axis and an upper assembly coupled to the lower member;

a light source mounted in the upper assembly;

at least one control button coupled to the upper assembly for controlling the light source;

a plurality of removable side plates arranged and designed to be attached to the lower member, the plurality of side plates providing various features to enhance the overall functionality of the flashlight system;

the lower member arranged and designed to receive at least one removable side plate, and wherein at least one of the plurality of removable side plates is removably attached to the lower member and comprises:

a slider body arranged and designed to attach to the lower member, the slider body including a pair of body rails in opposed relationship;

a top cover mounted onto the slider body, the top cover including a pair of cover rails in opposed relationship, the pair of cover rails being axially aligned with the pair of body rails;

a slide member having a pair of side edges arranged and designed to be slidably received between the pair of cover rails and the pair of body rails, the slide member having a finger opening arranged and designed for moving the slide member in an axial direction and having an elongate slot in the axial direction; and a fastener extending through the elongate slot and securing the top cover to the slider body, the fastener limiting the amount of axial movement of the slide member relative to the slider body.

10. The flashlight system of claim 9, further comprising:

the slider body including a recessed flex tab having a ball receiver;

the slide member including a first hole and a second hole;

a ball partially received in the ball receiver, wherein the slide member has a retracted position and an extended position, in the retracted position the ball is partially received in the first hole and in the extended position the ball is partially received in the second hole, the slide member holes, ball, ball receiver and flex tab providing a detent in the extended and retracted positions.

11. The flashlight system of claim 9, wherein the slide member has a hook-shaped end portion having a beveled, knife-like interior edge.

12. The flashlight system of claim 9, wherein the slide member has a hook-shaped end portion forming a bottle opener.

13. A flashlight system comprising:

a housing assembly including a lower member having a longitudinal axis and an upper assembly coupled to the lower member;

a light source mounted in the upper assembly;

at least one control button coupled to the upper assembly for controlling the light source;

a plurality of removable side plates arranged and designed to be attached to the lower member, the plurality of side plates providing various features to enhance the overall functionality of the flashlight system;

the lower member arranged and designed to receive at least one removable side plate, wherein at least one of the plurality of removable side plates is removably attached to the lower member;

a door pivotally connected to a lower end of the lower member;

a retention loop connected to the lower end of the lower member, wherein in a first position the retention loop is arranged and designed to maintain the door in a closed position preventing removal of the at least one removable side plate attached to the lower member.

14. The flashlight system of claim 13, wherein the retention loop has a second position arranged and designed to allow the door to move to an open position to permit removal of the at least one removable side plate from the lower member.

15. A flashlight system comprising:

an elongate member having first and second ends and defining a longitudinal axis between the first and second ends, the elongate member having an exterior surface defining an elongated first receptacle extending from the second end towards the first end of the elongate member;

an upper assembly mounted at the first end of the elongate member, the upper assembly having a light source mounted thereto;

a door coupled to the second end of the elongate member, the door having an open position and a closed position; and a first removable side plate engaged with the first receptacle, wherein the door in the closed position abuts the first removable side plate and prevents removal of the first removable side plate from the elongate member, and in the open position allows removal of the first removable side plate from the elongate member.

16. The flashlight system of claim 15, further comprising:

the exterior surface of the elongate member defining a second receptacle;

a second removable side plate engaged with the second receptacle, wherein the door in the closed position abuts the second removable side plate and prevents removal of the second removable side plate from the elongate member, and in the open position allows removal of the second removable side plate from the elongate member.

17. The flashlight system of claim 16, wherein the first and second removable side plates are arranged and designed to engage with either of the first and second receptacles.

18. The flashlight system of claim 16, further comprising a finger retainer assembly coupled to the elongate member, the finger retainer assembly defining a substantially "D" shaped opening with the elongate member.

19. The flashlight system of claim 18, wherein the finger retainer assembly is coupled to the elongate member independent of the first and second receptacles.

20. The flashlight system of claim 15, wherein the upper assembly is rotatably coupled to the elongate member.

21. The flashlight system of claim 20, wherein the light source has an optical axis substantially perpendicular to the longitudinal axis of the elongate member.

* * * * *